US005437428A

United States Patent [19]

Mirza

[11] Patent Number: 5,437,428

[45] Date of Patent: Aug. 1, 1995

[54] PICTURE MOUNT SYSTEM

[76] Inventor: Felix Mirza, 33 Vista Firenza, Laguna Hills, Calif. 92653

[21] Appl. No.: 55,086

[22] Filed: Apr. 30, 1993

[51] Int. Cl.[6] ..... A47G 1/16

[52] U.S. Cl. ..... 248/467; 248/476; 40/152.1; 40/594; 24/683

[58] Field of Search ..... 248/467, 475.1, 480, 248/476, 901; 40/152.1, 594, 159.1; 24/683

[56] References Cited

U.S. PATENT DOCUMENTS

| | | | |
|---|---|---|---|
| 1,508,469 | 4/1913 | Sainberg . | |
| 2,030,135 | 2/1936 | Carpenter | 40/594 X |
| 2,486,593 | 11/1949 | Gardner | 248/467 X |
| 3,893,252 | 7/1975 | Chase . | |
| 3,987,569 | 10/1976 | Chase . | |
| 4,057,923 | 11/1977 | Chase . | |
| 4,268,000 | 5/1981 | Ulm . | |
| 4,309,016 | 1/1982 | Tendler | 248/467 |
| 4,815,836 | 3/1989 | Byers et al. | 248/480 |
| 4,947,565 | 8/1990 | Shadwell . | |
| 4,991,330 | 2/1991 | Heidari . | |

*Primary Examiner*—Blair M. Johnson
*Attorney, Agent, or Firm*—Frank L. Zugelter

[57] ABSTRACT

A picture frame mount (14) comprising first and second strips or tapes (17) (26) in crossed relationship, the one (26) having a channel (29) in which the other (17) is disposed. Tape (17) includes two tongues (20) (21) outside of the channel (29) and an aperture (18) in alignment with the channel (29). The bottom of tongues (20) (21) and the top of tape (26) include adhesive characteristics or coatings, while glue in aperture (18) fastens tape 26 to itself. The tongues (20) (21) are applied to a backing (11) and tape (26) is applied to artwork (12) to provide a "floating" arrangement when mounting between artwork and backing is undertaken. Release sheets (33) (34) protect the adhesive characteristics until the tapes are ready for use. An auxiliary mount (44) also is disclosed, fashioned by three elements (51), (52), (53),much like an "H" or an "I", the outer elements (51), (52) having adhesive characteristics on their opposing non-aligned sides to provide a 'pendulum-like' swing between and for sheet and backing when attached to them.

35 Claims, 3 Drawing Sheets

FIG. 1.
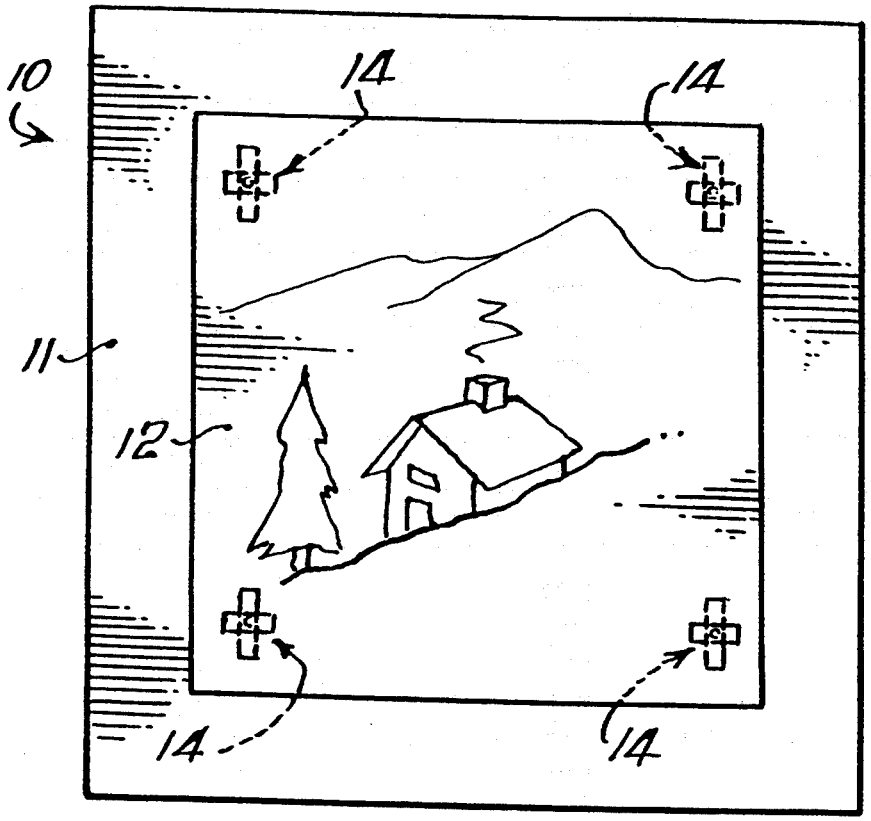
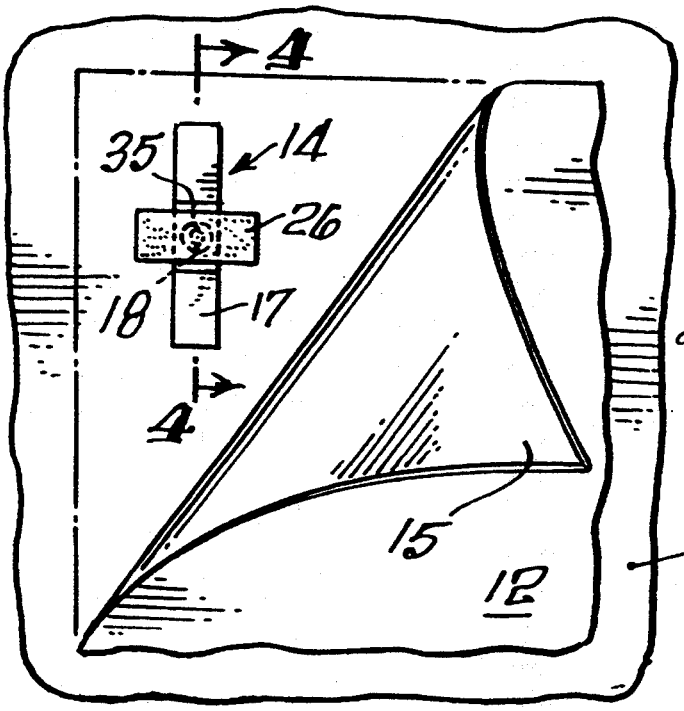
FIG. 2.

33
17
20
22
14
35
23
32
30
34
29
26
18
21
30
31
29
27
28
34
22
23

17
23
36
25
35
26
31
30
30
28
29
18
38
25
37
23

23
22
17
20
28
27

12
26
26
35
18
32
21
11
17
22
23

23
17
35
40
26
25
31
30
41
25
28
42
18
29
23

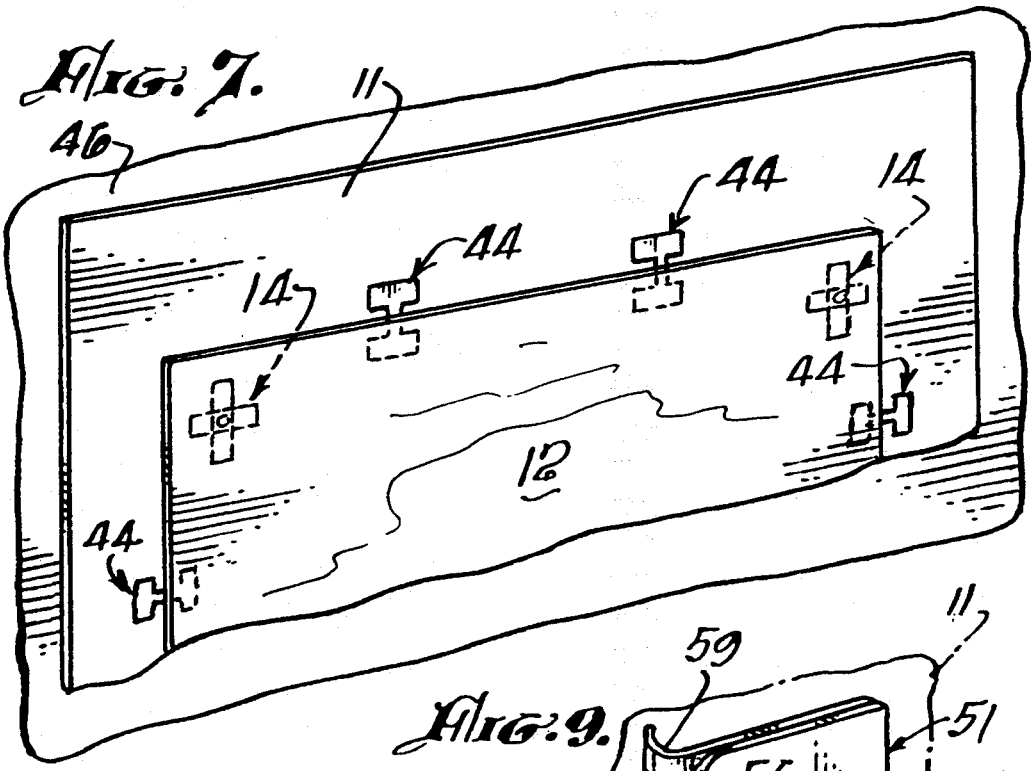
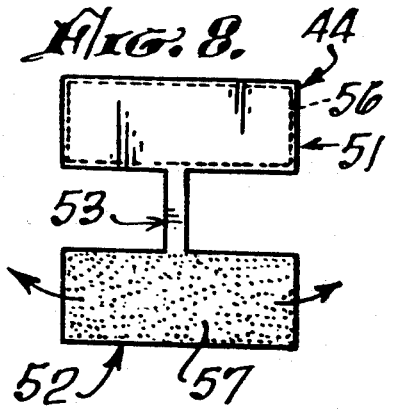
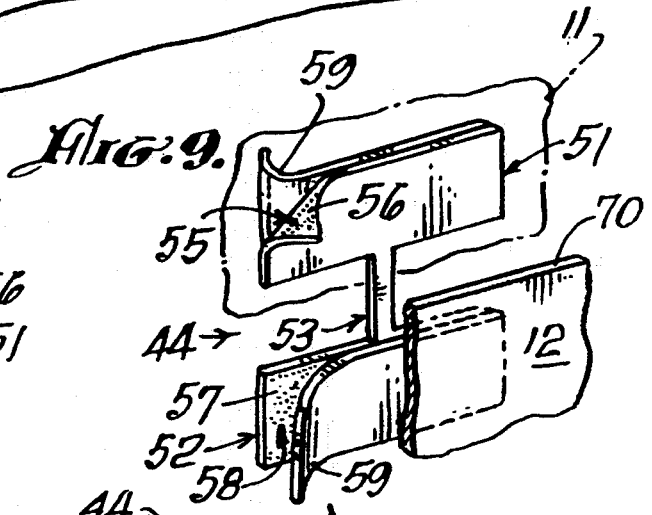
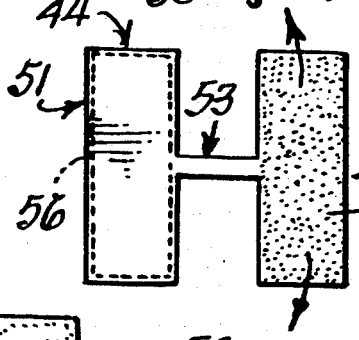
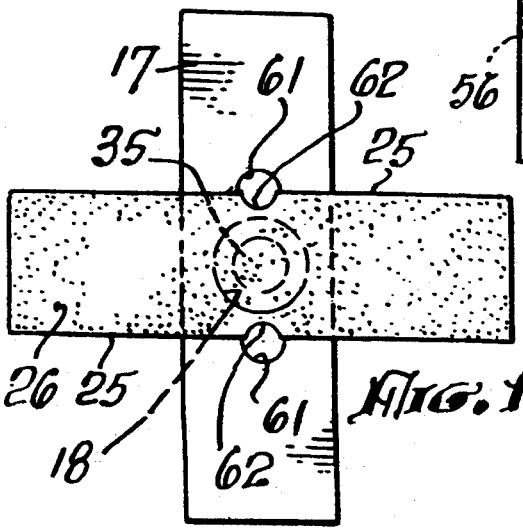
FIG. 12.
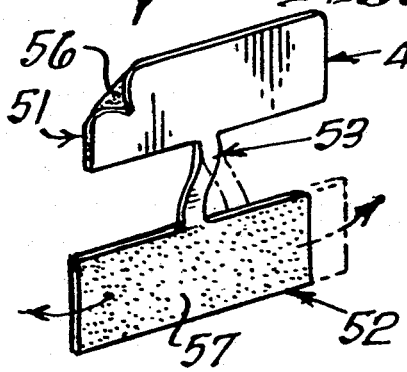

PICTURE MOUNT SYSTEM

TECHNICAL FIELD

This invention is directed to amounting device, devices, and system or combination of devices or systems, by which a picture or the like is mounted to a backing or the like, and particularly is directed to a true floating mount and system for artwork and by which the picture or the like floats on its backing, be it conservation paper or fabric covered mat or the like, while being secured thereto, while simultaneously providing for expansion and contraction of substantially all of the artwork's paper.

BACKGROUND OF THE INVENTION

Mounts for pictures and other papered-material-formed artwork have been in use for many years with improvements occurring from time to time, as shown in one or more of the following prior art disclosures, all hereby made by record: U.S. Pat. Nos. 1,058,469; 3,893,252; 3,987,569; 4,057,923; 4,268,000; 4,947,565 and 4,991,330. Further, as an example in prior practice, a two-sided adhesive tape strip has been used to secure artwork at the top only of a frame, by which the tape is hinged to provide a free hanging of the piece. However, the artwork then tends to 'swing out', towards the glass, curling as it does so, touching the glass when mildew gathers, and ruining the art. Another technique is to apply a one-sided adhesive tape with its adhesive side applied to the artwork while glue is applied to the other side of the tape; this being a primitive method in use for a long time. However, these teachings have not solved the problem of the effects of the curling up of an artwork's edges or the buckling (which permanently damages paper artwork) in other parts of the same artwork on paper in a frame, or behind its glass front or the like.

It also is known that works of art on paper expand with humidity and contract when dry. Present known methods involve fastening the artwork down around its edges at one or several inch intervals. But this method prevents the paper from lying flat as it expands. And where there is no linear room for the paper to expand, it buckles.

I had noticed that in the case of a mat (matte) over a picture, the picture was fastened to the mat with solid tape attaching the top face of the artwork to the back of the mat, using several such tapes across the top. Since the tapes were rigid they had no play in either left or right directions. I also noticed that all pictures buckled along their tops when they were so fastened, but lay flat on all other sides or edges that were not fastened. In other words, the pictures were hanging freely except for their tops where they had to be fastened.

This invention provides for a true free or floating arrangement for the artwork about all of its sides or edges while being securely mounted to a backing. It eliminates the detrimental effects of the above noted problems of buckling, as well as curling, rippling and waviness, since the paper can expand and contract along all of its sides or edges, as if it were not fastened down at all.

SUMMARY OF THE INVENTION

The invention comprises picture and auxiliary mounts for floating artwork to a backing while securing them together, while also providing for expansion and contraction of the artwork's papered material as it floats on the backing, resulting in the effect of the artwork not being fastened down at all. Each picture mount comprises assembled crossed and interlocking strips,tapes or members, one inserted in and projecting out of a channel formed in a leaf or leaves forming the other so that extensions or tongues are disposed on the former. Adhesive coatings are mounted or integrally formed on the tongues for securement to a backing, while an adhesive coating is mounted or integrally formed on the latter strip for securement to the artwork. An aperture in the former strip provides for positioning of a fastening means, such as a glob of glue therein so that the layers forming the leaf or leaves of the latter strip are attached to each other through the aperture, thus providing for a relative freedom of movement between the two strips about the fastening means. Such motion provides for a floating of artwork to backing when expansion and contraction conditions are such to cause movement between artwork and backing.

One or more auxiliary tapes provides for play, back-and-forth between artwork and backing, while being mounted along the edges and inwardly to some extent of the artwork's paper. Each auxiliary tape comprises a flat material forming three elements,resembling an 'I' or an 'H',the outer two elements being joined by a third, inner, thin or elongated membrane. An adhesive coating is mounted on the one face of one outer element and an adhesive coating is mounted on the opposite face of the second of such outer elements. The first outer element is secured to an edge of the backing by its adhesive coating while the second outer element is secured to the artwork at its edge. The thin membrane functions to provide a swing to-an-fro action for the artwork, an action similar to a pendulum's swinging, providing freedom of movement for the artwork vis-a-vis its backing.

These devices provide substantially the same strength as the rigid tape but in addition to such strength provides for the expansion and contraction of the artwork's paper under the mat in both left and right directions as well as a long vertical lines or orientation along which these devices also may be used.

The use of either or both of these two kinds of articles or devices in a combination or system for mounting a picture or other sheet on its backing provides a truly floating arrangement for the artwork or sheet, while preventing or eliminating buckling, curling, waviness, or rippling of the artwork.

An object of this invention is to provide a true floating yet securely mounting artwork or other sheet to its backing or the like.

Another object of this invention is to provide a novel means of securely mounting an artwork to a backing or frame or the like.

A further object of this invention is to provide inexpensive picture mount devices.

A still further object of this invention is to prevent or eliminate an otherwise ugly buckled, curled, wavy, or rippled appearance of an artwork.

Another object of the invention is to eliminate permanent damage to artwork on paper that would otherwise occur when buckling, curling, waving or rippling.

Another object of this invention is to provide a system of mounts, floating and auxiliary, for floating and securing an artwork, picture or the like to a backing or the like, without incurring the aforementioned disadvantages of buckling, curling, waviness, or rippling.

A still further object of this invention is to provide an ease of application of a mount or mount system, the application being simpler and more effective than what the state of the art now offers in these kinds of means.

Another object of the invention is to provide a device or devices having substantially the same strength as a rigid tape and which is required to hang artwork to its backing.

These and other objects and advantage will become more apparent by a full and complete reading of the following description, the appended claims thereto, and the accompanying drawings comprising three (3) sheets of twelve (12) FIGS.

BRIEF DESCRIPTION OF THE DRAWING

FIG. 1 is a frontal view of an artwork on backing, and in which subject matter of the invention (in phantom) is shown in suitable locations.

FIG. 2 is a frontal view of a fragmentary portion of FIG. 1, enlarged and partially dis-unified to show relationship of subject matter of the invention to the backing and to the artwork.

FIG. 7 is a perspective view of the invention's subject matter illustrate in FIGS. 1–6 in combination with other or auxiliary mounts of the invention, as applied to an artwork and its backing.

FIG. 8 is a frontal view of such auxiliary subject matter.

FIG. 9 is a perspective view of an auxiliary mount as it is applied to artwork and backing.

FIG. 10 is a perspective view of the FIG. 8 view, showing the auxiliary mount in a non-resting pendulum-like position, a portion of it having swung relative to another of its portions.

FIG. 11 illustrates the mount of FIG. 8, however, turned ninety (90°) degrees from its FIG. 8 orientation.

FIG. 12 illustrates a method for applying a fastening means at the center of the aperture in the one member of the subject matter of the invention.

DESCRIPTION OF THE BEST MODE OF CARRYING OUT THE INVENTION

Figure 3:
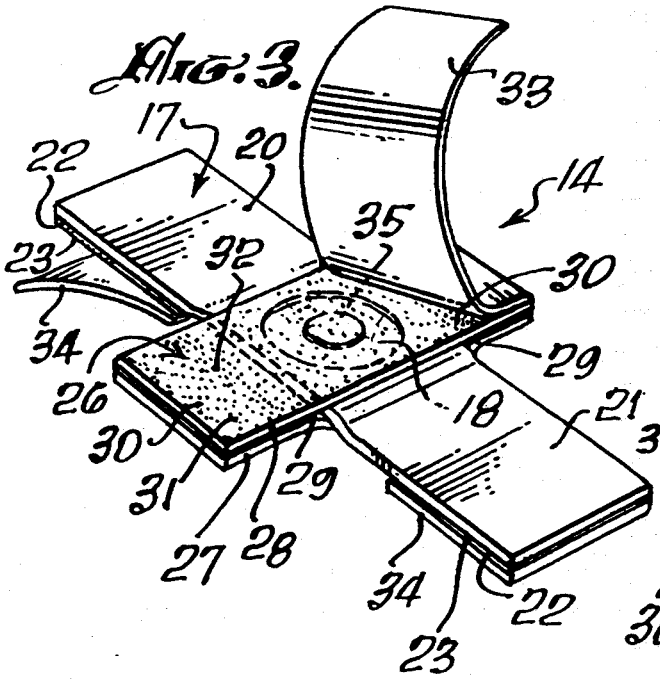
FIG. 3 is a perspective view of subject matter of the invention.

Referring now to the drawing wherein reference characters correspond to like numerals hereinafter, FIG. 1 illustrates a mating 10 of a backing or backing sheet 11 with an artwork 12, usually in the form of a suitable thinness of sheet, and a plurality of mounts 14 (shown in phantom behind artwork 12) by which backing 11 and artwork 12 float relative to one another while being securely mounted together. In most instances of use of the invention, mounts 14 are in relation to mounting a picture, lithograph, painting, serigraph, repligraph, or other artwork or the like to a backing in a frame (not shown) and glass pane or other transparent element (not shown) for the frame. However, it should be understood that these mounts 14 (and the auxiliary mounts, more fully described hereinafter) are applicable to sheets other than artwork and their backings. Also, that the application of the invention can be made directly upon a frame which incorporates a suitable backing, rather than to a backing 11.

For illustrative purposes, FIG. 1, four (4) mounts 14 [in phantom] are utilized for so floating and securely mounting the artwork 12 and its backing 11 together, although more or less than the four (4) shown may be used in a given instance and in different locations than illustrated. In FIG. 2, artwork 12is seen to have its one corner 15 rolled back, away from backing 11, openly exposing one (1) of the mounts 14, with the latter one being shown in mounted or applied position relative to the backing 11. Were the corner 15 to be reversely rolled, towards and onto and over the one mount 14 and backing 11, the reader then would be viewing a portion of FIG. 1,since such a reverse rollback would position the artwork 12 over and to the mount 14 and as shown in FIG. 1.

Figure 5:
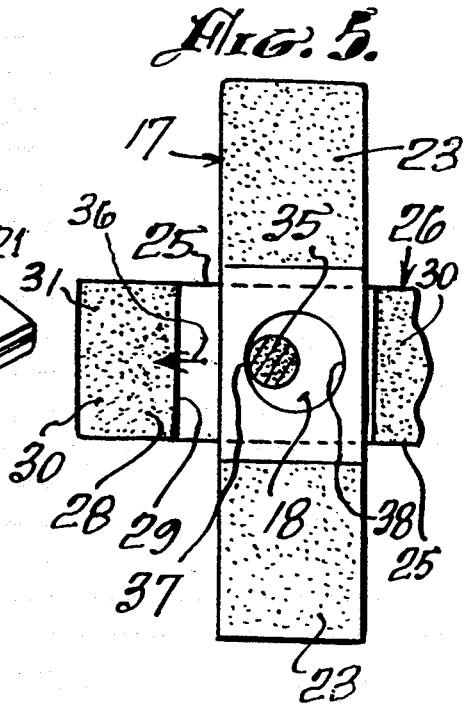
FIG. 5 is a bottom plan view of a portion of the subject matter of the invention, illustrating capability of expansion and contraction in a horizontal manner for artwork or the like when attached to it.
Figure 4:
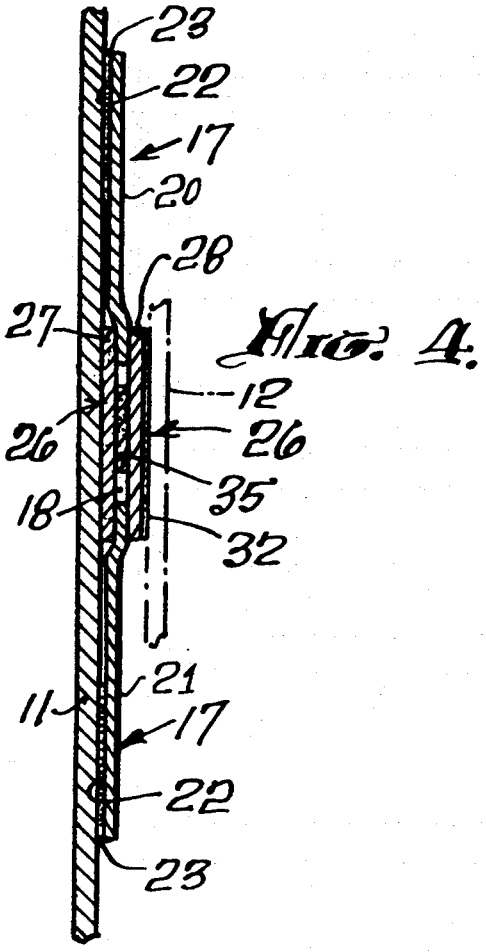
FIG. 4 is a view taken on line 4—4 of FIG. 2.
Figure 6:
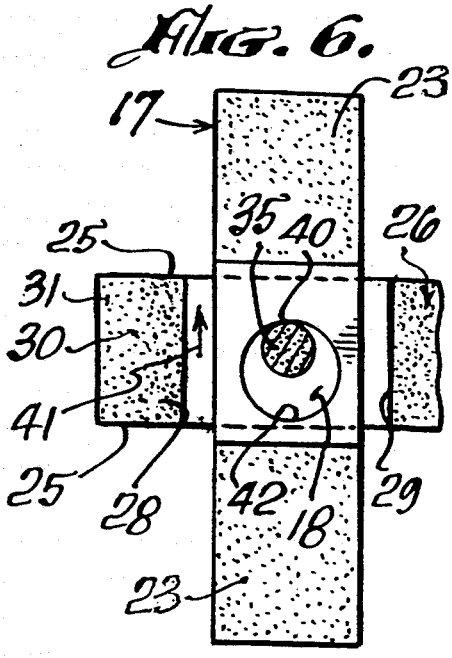
FIG. 6 is a bottom plan view of the same portion of the subject matter of the invention, illustrating capability of expansion and contraction in a vertical manner for artwork or the like when attached to it.

FIGS. 3, 5 and 6 illustrate amount 14 constituting subject matter of the invention, while FIG. 4 illustrates it in place in relation to backing and artwork. Mount 14 comprises, FIGS. 3, 4, a first member, strip or tape 17 in which an aperture 18 is formed therethrough, the aperture 18 being preferably centrally located therein. The first member 17 includes two (2) tongues or extensions 20, 21, in opposing relation, with aperture 18 between them. Tongues 20, 21 include corresponding undersides 22 (FIGS. 3, 4) and to which an adhesive characteristic or coating 23 is mounted on or integrated into the material of the tongues, so that such undersides 22 can adhere by means of the adhesive coatings 23 to backing 11. Tongues 20, 21 extend beyond each side edge 25 (FIGS. 5, 6) of a second member, strip or tape 26 that is disposed in a crossed relationship to the first member 17 that includes the aperture 18. The second member 26 comprises a leaf or leaves forming two (2) layers 27, 28 of suitable material, such as the same kind as that of the first member 17, so long as the layers are strong or smooth enough to not burden the movement of member 12. It is in these two layers that an opening or channel 29 (FIG. 3) is formed or located. The channel 29 is preferably centrally located in member 26. Aperture 18 is in alignment with or otherwise disposed within the boundaries or confines of the channel 29, between the tongues or extensions 20, 21. I.e., channel 29 accommodates such aperture 18.

Where layers 27, 28 are incorporated into a leaf or leaves forming the member 26, they are suitably securely connected or attached to each other at locations 30 (FIGS. 3, 6), which locations 30 preferably take areal form. Suitable attaching means, such as an adhesive material itself, provides for such attachments. The locations 30 are disposed in opposing relationship to each other across channel 29, each of their areal forms lying preferably between their corresponding ends on second member 26 and channel 29, while nevertheless providing adequacy or latitude in width for channel 29 to accommodate the width of and some relative movement for member 17. Member 26 or its layer 28 includes an outer side 31 to which an adhesive material or coating 32, FIG. 3, is applied in a convenient manner, such as by impregnation of or in the formation of the layer itself. Prior to usage of the mount 14, a release means or sheet 33, FIG. 3, is mounted on the adhesive coating or material 32 and extends throughout and upon the areal dimensions of layer 28 to protect its adhesive characteristics for adhering purposes in the use of subject matter of the invention. FIG. 3 illustrates a sheet 33 partially peeled off of layer 28 and from its adhesive coating or material 32, in preparation of using the mount 14, the adhesive characteristic of coating or material 32 being exposed as if in preparation of pressing it and the artwork 12 together. Similar protective release means or sheet 34, FIG. 3, are similarly provided for tongues 20, 21 of member 17, prior to use of the mount 14. A sheet 34 may extend the full length of member 17, rather than taking the form of two (2) sheets as illustrated, as long as the tongues 20,21 prior to their use are protected thereby, to provide efficacy for them in use of the device.

A fastening means 35, an example being glue, say, in the form of a "glob" so to speak, attaches member 26 to itself, i.e., in the illustrated embodiment its two layers 27, 28 fasten themselves together, through the aperture 18. Thus, members 17, 26 are slidably related to each other to the extent of their movement about the fastening means 35, this being demonstrated by the illustrations of FIGS. 5 and 6, while simultaneously being interlocked by the fastening means 35.

FIG. 5 is viewed by the reader from the position of the backing 11, i.e., from under the member 17 of the mount 14 illustrated in FIG. 2. Protective sheets 34 have been removed from adhesive coatings 23, while the one layer 27 of member 26 does not appear, for clarity. With member 17 being assumed in a vertical orientation in its location in FIG. 1, it is observed that the fastening means 35 attached to the second member 26 (represented by upper layer 28 in FIG. 5) has moved in the direction of arrow 36to one extreme position 37 in the periphery of aperture 18 in the figure. Member 26 is likewise capable of moving to the other (in horizontal fashion) opposing extreme position 38 in the periphery of aperture 18, against the direction of arrow 36. Vice versa, member 17 can move in either horizontal direction, in relation to member 26, so that fastening means 35 engages positions 37 and 38. Channel 29 is provided with latitude in its width for such relative movement, FIGS. 5, 6. The fastening means 35 in either case limits the extent of these movements by either member 17 or 26 between the positions 37 and 38.

In FIG. 6, with the same orientation for members 17 and 26 as is in FIG. 5,it is to be observed that the second member 26, again with its one layer 27 removed for clarity, has moved to one extreme vertical position 40 by reason of having moved in the direction of arrow 41. Member 26 is likewise capable of moving to the opposing extreme vertical position 42, against the direction of arrow 41. Vice versa, member 17 can move in either vertical direction, in relation to member 26, so that fastening means 35 engages either of the positions 40, 42. The fastening means 35 in either case limits the extend of this vertical movement between the two positions 40 and 42.

Thus, it now should be apparent that either member 26 and/or member 17 can move up or down, or sideways, or in any other planar manner in relation to the other, the glue or other fastening means 35, the nature of the periphery and the size of aperture 18, and the amount of latitude in channel 29, limiting the extent of these movements.

FIGS. 7 through 11 illustrate one or more auxiliary mounts or tapes 44 as well as its or their relation to mounts 14, artwork 12 and backing 11 when applied to an artwork and its backing. Mounts 44 along with mounts 14, in FIG. 7, are shown in locations between artwork 12 and backing 11. A wall 46 provides a background for this illustration of use, and it should be understood that frame and hanger have been eliminated for clarity purposes.

Mounts 44 are used by themselves or in combination with mounts 14 to form a system of freely floating mounts for pictures and their backings. A purpose of a mount 44 is to securely mount artwork to backing, preventing the artwork primarily from downward fall, though they may be used along vertical lines of orientation as well (FIG. 11). However, s the following description will show, these mounts also produce a freedom of movement between artwork and backing during conditions of expansion and contractions should one or both of these conditions occur.

Each mount 44 comprises (FIGS. 8–11) three (3) elements 51, 52, and 53 that are formed in or integrated into a single flat, thin member to form itself. Element 51 comprises a member adjacent the one end or top of the member 44, its one solid face 55 (on one of its sides FIG. 9) including an adhesive coating 56 preferably extending throughout the same general areal dimensions as that of the face itself. Element 52 comprises a member adjacent the other or bottom of mount 44, being spaced from element 51, and includes an adhesive coating 57 mounted on its solid face 58 on the opposite side of mount 44, the coating 57 preferably extending throughout the same general areal dimensions as its face. It is to be noted that the faces 55, 58 are non-aligned with each other as well as not being co-planar with each other, FIG. 9, and are on opposing sides of the flat, thin mount 44. Element 53 comprises a connecting link or membrane for elements 51 and 52, elongated and narrow in appearance as shown, and consequently conducive to some 'pendulum-like' swing, FIG. 10, between elements 51 and 52, but more particularly between an artwork and backing attached thereto. The faces on the surfaces or on the sides correspondingly opposing surfaces or sides that include faces 55, 58 do not include adhesive coatings, the exposure of which would defeat the 'pendulum-like' swinging desired between artwork and backing. Elements 51 and 52 are of substantial dimensions (i.e., each having a length and width) in contrast to those of the link or arm 53, and preferably are totally solid vis-a-vis being partially solid, since they effect a firm or sound secured mounting of artwork to its backing, while arm 53 provides the floating or swinging effect for the artwork relative to its backing. It may be said that mount 44 appears in silhouette fashion like the alphabet letter I or the letter H, and even as a physical exercising dumbbell.

In application to artwork and backing, the adhesive coating 56 is finger-pressured applied to a backing and the adhesive coating 57 is finger-pressured applied to artwork, this more fully described below in the description of the practice of the invention.

FIG. 11 illustrates the same auxiliary mount 44 as that of FIGS. 8 and 9, however it has been turned in a ninety degree (90°) orientation so as to be useful along the vertical sides, i.e., in a vertical orientation, of an artwork and backing. Such usefulness is illustrated in FIG. 7 along such vertical sides, while along the top or horizontal edges of the artwork and backing, a plurality of mounts 14 along with a plurality of auxiliary mounts 44 are shown to be floating and securing artwork and backing together.

Release sheets 59, FIG. 9, are provided for protecting the adhesive coatings 56, 57 on the faces 55, 58, respectively, prior to applying these auxiliary mounts to a backing and artwork, such sheets being similar to or like those protecting the adhesive characteristics of the particular adhesive-like elements in mounts 14. In the event membrane 53 includes release sheets on each of its sides in the fabrication of mount 44, they would not be removed as like the case of such sheets being removed from faces 55, 58 of elements 51, 52, respectively.

FIG. 12 illustrates a technique and method, by which the fastening means 35 is deposited or positioned at the center of aperture 18 of member 17, for the purpose of an actual application of the invention. Indicia means 61, 62, examples being small circular cutouts and slits or notches, respectively, are formed on or in members 17 and 26, respectively, which, when mated to one another in the placement of the two members one upon the other, assures the exact centering for positioning or depositing fastening means 35 in the aperture 18. Each of a pair of indicia 61 is formed across the width of and centered in member 17, being spaced apart from each other a distance equal to the width of member 26, noting that aperture 18 lies in member 17 between such indicia 61. In turn, each of a pair of indicia 62 is formed in the layer 27 of member 26 along its corresponding edge 25 of member 26, opposing one another along a geometrical line perpendicular to edges 25. Such geometrical line coincides with the center of channel 29. In the assembly of the two members 17 and 26, a glob of glue is deposited along such geometrical line and on layer 27 (see FIG. 3), after which member 17 with its aperture 18 is positioned over such glob of glue. The indicia 61 on member 17 is mated to indicia 62 during such depositing, thereby making certain that the fastening means 35 (glue) is centered in the assembled mount 14. Release sheets 33, 34 may, of course, now be assembled to adhesive coatings 32, 23, respectively, in the event mount 14 is not going to be used immediately.

In use of the interlocked members 17, 26, release sheets 34 (or if but one, then such one) are peeled off from the member 17 of each mount 14 to be used, more particularly, from adhesive coatings 23 thereon, and thereafter coatings (or coating) 23 are finger-pressure applied to backing 11, FIGS. 1, 2. As many times as are mounts 14 required or desired to float and securely mount a picture, artwork, or the like, to a backing 11 (or directly to a frame, wall, or the like) is this step undertaken. With such mounts 14 now adhesively applied to backing 11, the release sheet 33 is peeled off from each of members 26 of each mount 14, exposing the adhesive coating 32 on the outer side 31 of its layer 28. Thereafter, the artwork or the like 12 is carefully positioned upon all the mounts 14, as illustrated in FIG. 1, and fingered pressure to all the mounts 14, perhaps one by one or in any other manner comfortable to use by the person utilizing the invention. With the application of the aforedescribed centering method for an exact centering of fastening means 35 to aperture 18, the preferred freedeom of movement for artwork 12 relative to its backing 11 is achieved, thus truly "floating" and securely mounting the artwork at the same time. The extent of such movement, of course, is limited by engagement of the fastening means 35 with the periphery of aperture 18, nevertheless, the artwork floats and remains secured to backing 11.

In the event mounts 44 are used, singularly or by themselves or with mounts 14, upon a backing and an artwork, and in the illustration (FIG. 7)of application along the upper or top of artwork and backing,the release sheet 59 is removed from face 58 of element 52 to expose the adhesive characteristics of coating 57. Face 58 of element 52 then is secured to artwork 12, preferably having its one edge in alignment with edge 70, FIG. 9, of the artwork 12. As many mounts 44 that are desired may be applied in this manner, not only along the top edge of the paper underlying the artwork but on all side edges of the artwork if desired. The release sheets 59, either one at a time or otherwise, are removed now from the face 55 of element 51, exposing the adhesive characteristics of coating 56. It is each such coating 56 that is applied to the backing 11 as the artwork is carefully mounted thereto, in order to obtain the desired orientation of artwork to backing.

Application of one or both of these kinds of mounts 14, 44 precludes the buckling, curling, waviness, or rippling of the artwork while mounted as indicated upon its backing. With the expansion or contraction of the artwork and its underlying paper, the mounts are free to move to the dimensions or degrees that are provided by aperture 18 in mounts 14 and by the swinging pendulum-like link or arm 53 in the mounts 44.

In assembly of mount 14, an aperture 18 is punched through a tape-fabricated member 17 having an adhesive coating 23 on its one side, FIG. 3. Release sheets 34 are mounted to the portions of the side of member 17 having such adhesive characteristics. The aperture 18 of member 17 is laid across the central potion of layer 27 forming tape-fabricated member 26. Using the above described method of centering the glue, and applying the glue in such method, thereafter, layer 28, with its release sheet 33 already applied to its adhesive coating 32 if desired, is mounted upon member 17 as shown in FIG. 3. Mount 14 now is assembled and ready for later use when the release sheets 33, 34 can be removed by peeling them off and applying the mount 14 to backing and artwork.

One manner of assembly or fabrication for a mount 44 is to take a tape member having double-sided adhesive characteristics, and with a scissors cut out portions by which the stem or membrane 53 and elements 51 and 52 are shaped. Then, in use, each release sheet from each element 51, 52 is removed so that the mount 44 can properly function.

The inventive concept pertaining to the mount 44 includes a configuration in an article that is a single, flat, somewhat elongated, thin membrane-like tape or strip, having opposing, non-aligned faces mounted on its sides forming the thin membrane-like tape or strip, with adhesive characteristics included in each of such faces for attachment to corresponding artwork and backing members. A length of the thin membrane-like element and having no adhesive characteristics on either of its sides can even provide a distance between such faces in the article.

It now should be apparent that the mounts 14 and 44 are small enough in relation to sheets/artworks and backings to which they are attached that any expansions or contractions occurring in the sheets/artworks or backings are insignificant where these mounts may be located. However, for the linear remainders of the sheets/artworks and backings, these being the greatest portions thereof and along which the mounts are not attached, the expansion or contraction of the paper does not prevent a continuing floating of the artwork relative to the backing. Thus, the ugly appearance of the effects of any buckling, rippling, waviness, or curling are substantially removed or completely eliminated while the desired appearance of the artwork(s) itself remain in visual tact.

The materials used for producing mounts 14 and 44 are well known in the art. Adhesive tapes, single and double-sided adhesive coatings on tapes,release sheets, and glue are all well known in the art. The members 17, 26 can be of usual adhesive materials, with member 17 in its center not being provided with adhesive if two (2) release sheets 34 are provided. Also, ordinary paper products can be cut to form the parts or elements of mounts 14 and 44, and then water-based, acid-free glue, or other desired glue, is applied to the necessary parts or elements of such paper products to generate the adhesive agents in their proper locations for carrying out practice of the invention.

In some instances of use, if desired, rice paper may be use for a mount 44, where caution must be critically exercised in determining whether the artwork or backing is to break or tear first, in the event of the occurrence of a sudden movement for the artwork from its static position, say, hanging along a wall. With rice paper and glue forming one or more mounts 44 applied to the artwork, upon such a movement the rice paper would break apart or tear first, thus saving the artwork from ruinination.

It should be understood that other tape elements may be used along with the subject matter of the invention. For example, anchoring tapes are used at the top of an artwork, anchoring artwork to backing at a particular point, to prevent the artwork from shifting downwardly. Such anchoring does not interfere with the expansion or contraction of the artwork, but is used to maintain a specific positioning of the artwork to its backing. This step is used particularly where the artwork is on heavier paper requiring additional anchoring to prevent such shifting.

Various changes and modifications and different ways of use may be made with the invention, illustrated or otherwise, and in its employment as well, without departing from its spirit and scope. The tongues 20, 21 may be attached to the artwork 12 and the strip 17 attached to the backing 11. Member 17 may be applied to the artwork 12 instead of member 26 which in turn then is applied to backing 11, their corresponding adhesive-characteristic surfaces being applied singularly to the artwork and to the backing, i.e., such surfaces of both members 17, 26 not being applied together to either the artwork or to the backing, this being apparent; however, it is made explicit here to avoid misunderstanding in the appended claims. The portions of member 26 not forming the channel 29 may be formed from one leaf alone, if possible, vis-a-vis the need for at least two leaves or layers that form the body formation for channel 29. If coatings 23 and 32 (or their surfaces or materials ) with their adhesive characteristics are not inherently part of the strips or members 17, 26, any suitable adhesive film or coating may be applied separately. The mounts 14, 44 may be applied directly to a wall rather than upon a backing, and a sheet, artwork or the like mounted in a floating and secured manner to them, singly or in multiple numbers by themselves or in combination with one another as desired. And the mounts 14, 44 may be utilized along the sides (vertically oriented) of artworks, backings and the like, as suggested in FIG. 7 by the mounts 44 appearing therealong. Also, with an absence of aperture 18 in its member 17, a fastening means 35 would not be required. Were such a device made without the aperture 18 (comprehended within the inventive concept), one drawback would be that the device could lift upwardly with the roll of the paper with which it would be attached. Whereas, the purpose of fastening means 35 is to keep the member 26 from coming away from member 17, hence, keeping the artwork close to its backing.

INDUSTRIAL APPLICABILITY

The invention is useful in the art world in which pictures or the like are mounted to backings and frames. However, the invention is applicable to any sheet-like material that is desired to be hung in the manner and mode described above.

I claim:

1. A device for securely mounting a sheet to a backing and comprising a first member including opposing tongues,the tongues having sides with adhesive characteristics, and a second member having a side and in which a channel is formed, said first member disposed in the channel in a crossed relationship to said second member, its tongues extending outwardly of the channel, said side of said second member having an adhesive characteristic, said sides of said tongues and said side of said second member being adhesively mountable interchangeably to either the sheet or to the backing.

2. The device of claim 1 wherein the first member includes an aperture in alignment with the channel of the second member, and means mounted in the aperture for fastening said second member to itself.

3. The device of claim 2 wherein said fastening means comprises glue.

4. The device of claim 1 wherein said second member comprises at least two layers of material for form the channel.

5. The device of claim 4 wherein the first member includes an aperture in alignment with the channel of the second member, and means mounted in the aperture for fastening said second member to itself.

6. The device of claim 5wherein said fastening means comprises glue.

7. The device of claim 2 wherein said second member comprises at least two layers of material for forming the channel.

8. The device of claim 7wherein said fastening means comprises glue.

9. The mounting device of claim 1 or claim 2 or claim 3 or claim 4 or claim 5 or claim 6 or claim 7 or claim 8 including release means mounted on said sides of said tongues and on said side of said second member.

10. A mounting device for floating and securing together a sheet and a backing comprising a first member including opposing tongues having bottom surfaces with adhesive characteristics for adhering to either the sheet or the backing, said first member having an aperture disposed between said spaced tongues, a second member forming a channel said first member disposed in the channel in crossed relation to the first member, its aperture within the channel and its spaced tongues outside the channel, the second member including atop surface having an adhesive characteristic for adhering either to the sheet or to the backing, and means mounted in the aperture for fastening said second member to itself.

11. The mounting device of claim 10 wherein said second member forming the channel comprises at least two layers of material, with said top surface and its adhesive characteristic being in the top layer of said material.

12. The device of claim 11 including a release means mounted on said top surface.

13. The device of claim 11 including a release means mounted on said top surfaces.

14. The device of claim 11 including a release means mounted on said top surface and a release means mounted on said top surfaces.

15. The mounting device of claim 10 or claim 11or claim 12 or claim 13 or claim 14 wherein said fastening means comprises glue.

16. A mount for securing together two elements and comprising a pair of strips in crossed relationship to each other, the first of said pair including atop surface having an adhesive characteristic, side edges, and a channel in which the second of said pair is disposed, said second of said pair having an aperture in alignment with the channel and extensions beyond the side edges of the first of said pair, said extensions including bottom surfaces having adhesive characteristics, and means for fastening the first of said pair to itself through the aperture, whereby application of said adhesive characteristics to their corresponding first and second of the two elements provides a floating arrangement for either of such elements to the other in the securement of said mount to such elements.

17. The mount of claim 16 including release means mounted on the top surface of the first of said pair of strips.

18. The mount of claim 16 including release means mounted on the bottom surfaces of said extensions on the second of said pair of strips.

19. The mount of claim 16 including release means mounted on the top surface of the first of said pair of strips and release means mounted on the bottom surfaces of said extensions on the second of said strips.

20. The mount of claim 16 wherein the first of the pair of strips comprises layers of material in which the channel is formed.

21. The mount of claim 20 including release means mounted on the top surface of the first of said pair of strips.

22. The mount of claim 20 including release means mounted on the bottom surfaces of said extensions on the second of said strips.

23. The mount of claim 20 including release means mounted on the top surface of the first of said pair of strips and release means mounted on the bottom surfaces of said extensions on the second of said strips.

24. The mount of claim 16 or claim 17 or claim 18 or claim 19 or claim 20 or claim 21 or claim 22 or claim 23 wherein said fastening means comprises glue.

25. A picture frame mount comprising a pair of crossing tape members the first of which including a side having an adhesive characteristic and having a channel in which the second thereof is disposed, the second extending beyond the first of said tape members thereby forming tongues, said tongues having sides with adhesive characteristics, the second of said tape members having an aperture in alignment with the channel, and means for fastening the first of said tape members to itself mounted in the aperture, whereby a floating arrangement is achieved upon securement of the sides of said tongues and the side of the first of said members to respective elements that are securely mounted together by the mount.

26. The picture frame mount of claim 25 including release means mounted on said sides of said tongues.

27. The picture frame mount of claim 25 including release means mounted on said side of said first of said tape members.

28. The picture frame mount of claim 25 including release means mounted on said sides of said tongues and release means mounted on said side of said first of said tape members.

29. The picture frame mount of claim 25 or claim 26 or claim 27 or claim 28 wherein said fastening means comprises glue.

30. A manufacture comprising a backing, an artwork mounted on the backing, at least one mount operatively connecting said artwork to said backing and by which the artwork floats relative to the backing while being securely mounted thereto, said mount comprising a first strip having a channel therein and with a side having an adhesive characteristic, a second strip disposed in said channel and having tongues extending out of said channel, said tongues including sides with adhesive characteristics, said side and sides attached by their adhesive characteristics one to the artwork and the other to the backing.

31. The manufacture of claim 30 including at least one auxiliary mount attaching the artwork to the backing, said auxiliary mount comprising a single, flat, thin article formed by two members each having sides with opposing faces and a narrow membrane spacing each of the sides from the other, the two members having greater dimensions than that of said membrane, one of said faces on one of said sides and one of said faces in the other of said sides which are in non-aligned and opposing relationship to each other having adhesive characteristics, so that one of the sides adheres to the art work upon attachment thereto and the other of the sides adheres to the backing upon attachment thereto, the membrane providing a relative freedom of movement between the artwork and the backing upon such attachments.

32. The manufacture of claim 30 or claim 31 wherein said second strip includes an aperture disposed within said channel, and means in said aperture for fastening said first strip to itself.

33. The manufacture of claim 32 wherein said fastening means comprises glue.

34. A mount manufacture for connecting artwork to a backing comprising a single, flat, thin article formed by two members each having sides with opposing faces and a narrow membrane spacing each of the sides from the other said two members and membrane being co-planar, the two members having greater length and width dimensions than that of said membrane, one of said faces on one of said sides and one of said faces in the other of said sides which are in non-aligned and opposing relationship to each other having adhesive characteristics, so that one of the sides adheres to the artwork upon attachment thereto and the other of the sides adheres to the backing upon attachment thereto, the membrane providing a relative freedom of movement between the artwork and the backing upon such attachments.

35. A mount manufacture for connecting artwork to a backing comprising a single, flat, thin article formed by two members each having sides with opposing faces and a narrow membrane spacing each of the sides from the other, said two members and membranes being co-planar, said membrane being elongated and narrow relative to the length and width dimensions of said two members, one of said faces on one of said sides and one of said faces in the other of said sides which are in non-aligned and opposing relationship to each other having adhesive characteristics, so that one of the sides adheres to the artwork upon attachment thereto and the other of the sides adheres to the backing upon attachment thereto, the membrane providing a relative freedom of movement between the artwork and the backing upon such attachments.

* * * * *